US009291373B2

(12) United States Patent
Hildreth, Jr.

(10) Patent No.: US 9,291,373 B2
(45) Date of Patent: Mar. 22, 2016

(54) FIXED AND VARIABLE REFRIGERANT METERING SYSTEM

(75) Inventor: Edward D. Hildreth, Jr., Clarksville, TN (US)

(73) Assignee: Trane International Inc., Piscataway, NJ (US)

( * ) Notice: Subject to any disclaimer, the term of this patent is extended or adjusted under 35 U.S.C. 154(b) by 2129 days.

(21) Appl. No.: 12/291,116

(22) Filed: Nov. 6, 2008

(65) Prior Publication Data

US 2010/0107659 A1 May 6, 2010

(51) Int. Cl.

| | |
|---|---|
| ***F25B 5/00*** | (2006.01) |
| ***F25B 1/00*** | (2006.01) |
| ***F25B 49/00*** | (2006.01) |
| ***F25B 5/02*** | (2006.01) |
| ***F25B 6/02*** | (2006.01) |
| ***F25B 39/02*** | (2006.01) |
| *F25B 41/06* | (2006.01) |

(52) U.S. Cl.

CPC ... *F25B 5/02* (2013.01); *F25B 6/02* (2013.01); *F25B 39/02* (2013.01); *F25B 41/062* (2013.01); *F25B 41/067* (2013.01); *F25B 2400/06* (2013.01); *F25B 2400/075* (2013.01); *F25B 2600/21* (2013.01)

(58) Field of Classification Search

USPC ..... 62/196.4, 198, 199, 200, 205, 208, 177, 62/501, 196.1, 152; 165/274, 292

See application file for complete search history.

(56) References Cited

U.S. PATENT DOCUMENTS

| | | | | |
|---|---|---|---|---|
| 4,373,353 | A * | 2/1983 | Anzalone | 62/200 |
| 4,567,733 | A * | 2/1986 | Mecozzi | 62/175 |
| 4,628,700 | A * | 12/1986 | Alsenz | 62/152 |
| 5,333,470 | A | 8/1994 | Dinh | |
| 6,085,533 | A * | 7/2000 | Kaido et al. | 62/196.2 |
| 6,553,778 | B2 * | 4/2003 | Tipton et al. | 62/196.1 |
| 6,705,094 | B2 * | 3/2004 | Alsenz | 62/116 |
| 6,751,965 | B1 * | 6/2004 | Gottlieb | 62/117 |
| 6,895,774 | B1 * | 5/2005 | Ares et al. | 62/332 |

* cited by examiner

*Primary Examiner* — Khoa Huynh
*Assistant Examiner* — Timothy K Trieu
(74) *Attorney, Agent, or Firm* — William O'Driscoll

(57) ABSTRACT

A refrigerant cooling system includes multiple evaporator coils fed by one variable refrigerant metering device and one or more fixed refrigerant metering devices. To avoid condensed moisture on the coils from being entrained by the supply air and ultimately adversely increasing the humidity of a room or comfort zone of a building, the variable refrigerant metering device delivers refrigerant to the evaporator's lowermost coil at a superheat that is less than that of the other higher coils. To operate the refrigerant system at various loads, two or more compressors are selectively energized individually and in combination for various stages of capacity, while the variable refrigerant metering device is active at each stage. The refrigerant system may include multiple refrigerant circuits that are hermetically isolated from each other, or two or more of the circuits may be in fluid communication with each other.

17 Claims, 3 Drawing Sheets

FIXED AND VARIABLE REFRIGERANT METERING SYSTEM

FIELD OF THE INVENTION

The subject invention generally pertains to refrigerant systems and more specifically to a system for metering the flow of refrigerant to a multi-coil evaporator.

BACKGROUND OF RELATED ART

Typical refrigerant systems comprise a compressor for compressing a refrigerant, a condenser for condensing and releasing heat from the compressed refrigerant, a fixed or variable metering device for throttling and thereby cooling refrigerant leaving the condenser, and an evaporator that uses the cooled refrigerant from the metering device to cool a current of air being supplied to a comfort zone, such as a room or area in a building.

In some cases, an evaporator comprises multiple coils each fed by a separate metering device. One or more of the metering devices may provide a fixed flow restriction, while another metering device provides an adjustable restriction to meet various operating conditions of the refrigerant system.

An example of such a system is disclosed in U.S. Pat. No. 4,373,353. Referring to FIG. 1 of the patent, expansion devices 6 and 7 are of "fixed construction" to provide full flow of liquid refrigerant to properly flood evaporator circuits #1 and #2. The uppermost evaporator circuit #3 of FIG. 1 is fed by a more restrictive variable expansion valve 8.

It seems, however, that such a system might be difficult if not impossible to operate at reduced load with only circuit #3 being active. Even it were possible to operate with just circuit #3 and variable expansion valve 8 being active while circuits #1 and #2 are deactivated, it appears that moisture in the air passing across evaporator 9 could condense on the relatively cool circuit #3 and then drain over inactive lower circuits #1 and #2. Supply air then blowing across evaporator 9 could perhaps entrain water droplets on the inactive lower circuits and carry that moisture to a comfort zone, thereby adversely increasing its humidity.

There appears to be a need for a more effective way of individually metering the flow of refrigerant to a multi-coil evaporator without having to use more than one variable expansion valve.

SUMMARY OF THE INVENTION

It is an object of the invention to provide a refrigerant system that includes a fixed refrigerant metering device and a variable refrigerant metering device for throttling the flow of refrigerant to a multi-coil evaporator.

Another object of some embodiments is to operate a compressor system at various stages of capacity while always using one variable refrigerant metering device at each stage including the stage of lowest compressor capacity plus one or more additional fixed refrigerant metering devices at stages of higher compressor capacity.

Another object of some embodiments is to operate a refrigerant system at various loads while maintaining the refrigerant in the lowermost evaporator coil at a superheat that is lower than that of any other coil of the evaporator.

Another object of some embodiments is to throttle the flow of refrigerant to a multi-coil evaporator with a variable refrigerant metering device that feeds the lowermost coil of the evaporator and a fixed refrigerant metering device that feeds the uppermost coil.

Another object of some embodiments is to use a variable refrigerant metering device and a fixed refrigerant metering device to throttle the flow of refrigerant to an evaporator that includes a plurality of intertwined coils.

Another object of some embodiments is to use a variable refrigerant metering device and a fixed refrigerant metering device to throttle the flow of refrigerant through a system that includes two or more circuits that are hermetically sealed and isolated from each other.

One or more of these and/or other objects of the invention are provided by a refrigerant system that include a plurality of evaporator coils fed by one variable refrigerant metering device and one or more fixed refrigerant metering devices, wherein the variable refrigerant metering device delivers refrigerant to the lowermost coil at a superheat that is less than that of the other higher coils.

DESCRIPTION OF THE PREFERRED EMBODIMENT

Figure 1:
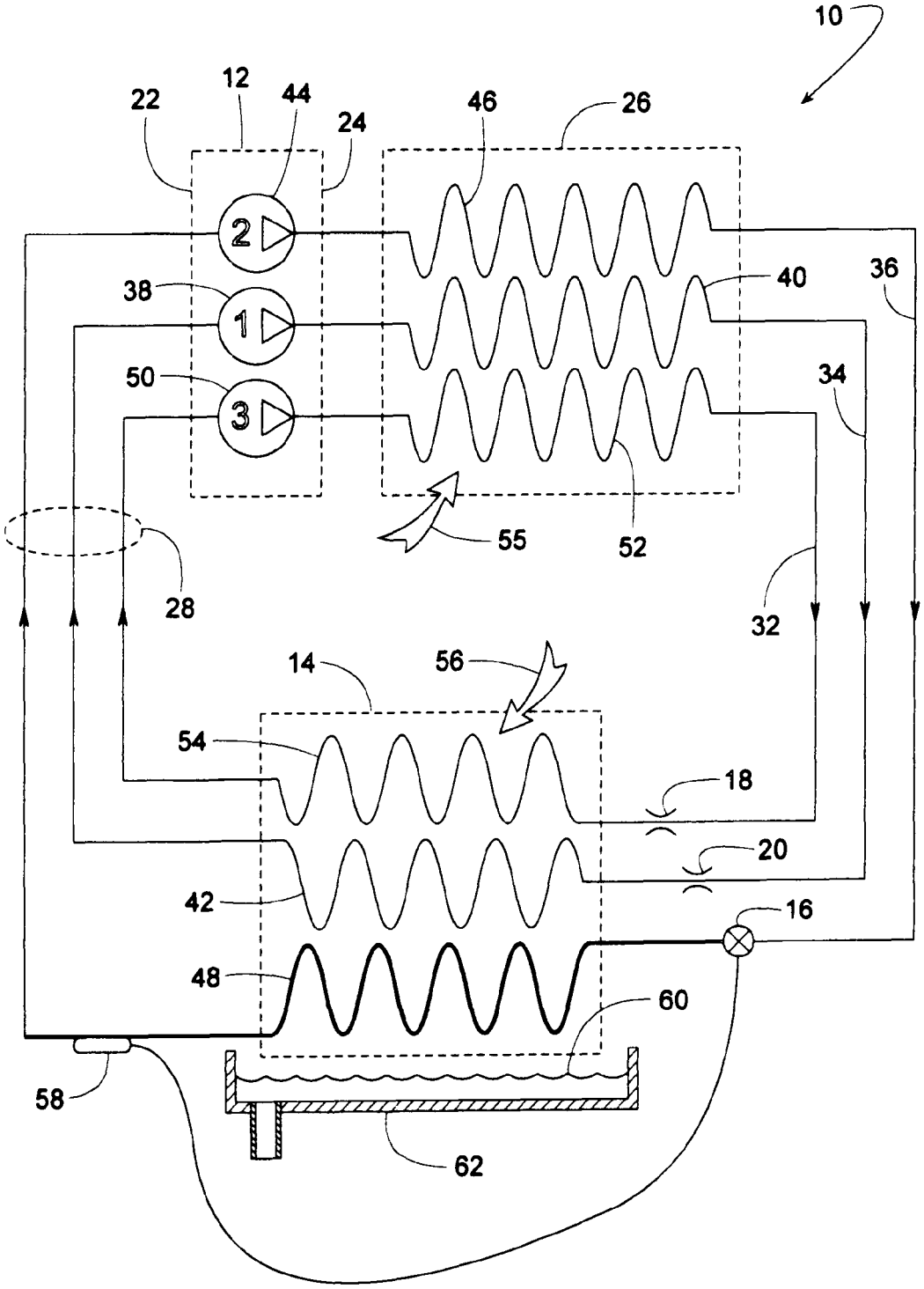
FIG. 1 is a schematic diagram of one example of a refrigerant system.

FIG. 1 schematically illustrates one example of a refrigerant system 10 that includes a variable capacity compressor system 12 and a multiple coil evaporator 14. Refrigerant system 10 is operable under various load conditions to meet a varying cooling demand. To minimize the cost and simplify the operational control of refrigerant system 10, a single variable refrigerant metering device 16 and one or more fixed refrigerant metering devices 18 and 20 throttle the flow of refrigerant to evaporator 14.

Figure 2:
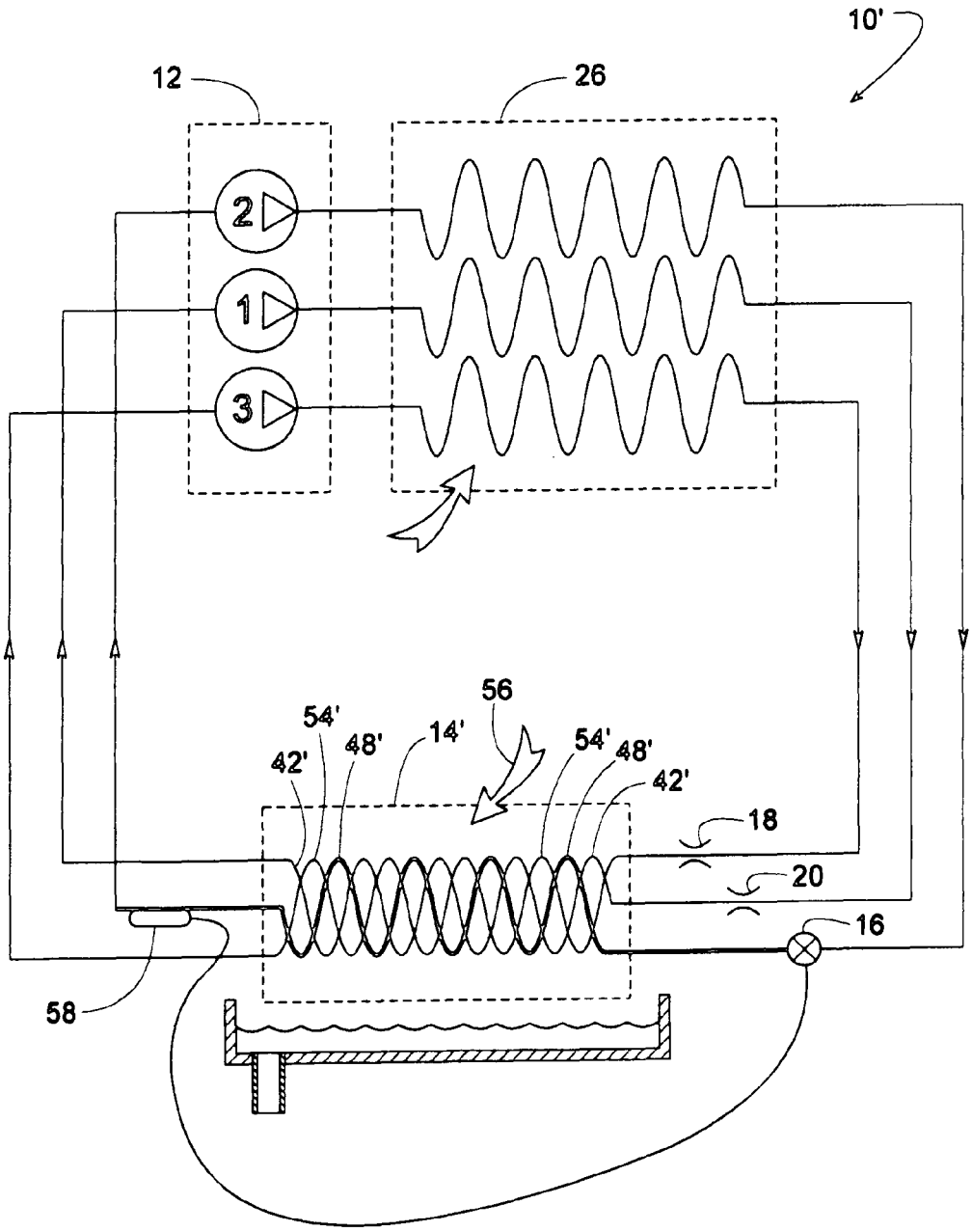
FIG. 2 is a schematic diagram of another example of a refrigerant system.
Figure 3:
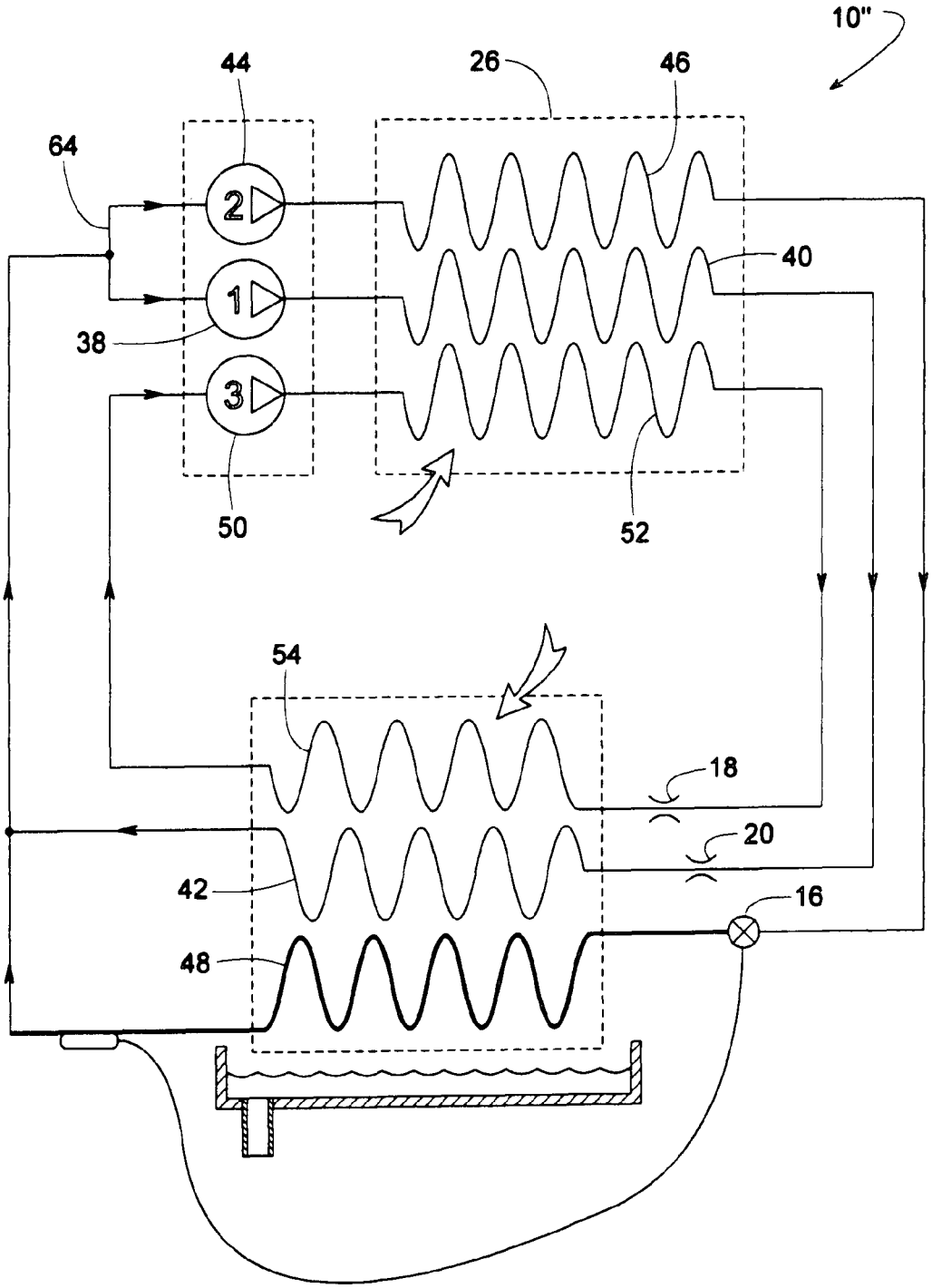
FIG. 3 is a schematic diagram of yet another example of a refrigerant system.

The actual construction and configuration of the refrigerant system 10 may vary, and FIGS. 1, 2 and 3 illustrate just three of the many possibilities. For sake of example, FIG. 1 shows refrigerant system 10 comprising compressor system 12 for compressing refrigerant from a suction side 22 to a discharge side 24; a multiple coil condenser 26 for condensing compressed refrigerant discharged from compressor system 12; metering devices 16, 18 and 20 for throttling refrigerant received from condenser 26; and evaporator 14 for vaporizing the refrigerant that was cooled by expansion upon passing through metering devices 16, 18 and 20. Evaporator 14 includes multiple coils that collectively provide a complete evaporator system. The expression, "complete evaporator system," means a heat exchanger that provides substantially all of a refrigerant system's heat exchange need for absorbing heat from an external fluid. From evaporator 14, lines 28 return the vaporized refrigerant back to suction side 22 of compressor system 12 to complete the cycle.

For this particular example, refrigerant system 10 includes three individual circuits 30, 32 and 34 that are hermetically isolated from each other, thus the refrigerant in circuit 32 does not mix with the refrigerant in the other two circuits 34 and 36. Circuit 34 includes a first compressor 38 of compressor system 12, a first condenser coil 40 of condenser 26, fixed metering device 20, and a first evaporator coil 42 of evaporator 14. Circuit 36 includes a second compressor 44 of compressor system 12, a second condenser coil 46 of condenser 26, variable refrigerant metering device 16, and a second evaporator coil 48 of evaporator 14. And circuit 32 includes a third compressor 50 of compressor system 12, a third condenser coil 52 of condenser 26, fixed metering device 18, and a third evaporator coil 54 of evaporator 14. A variation of refrigerant system 10 would comprise just the first and second circuits 34 and 36 without the third circuit 32, or system 10 could comprise four or more circuits.

To vary the capacity of compressor system 12, compressors 38, 44 and 50 can be selectively energized individually or in various combinations. For minimum or lower capacity, compressor 44 can be energized while compressors 38 and 50 are de-energized. For higher capacity, compressors 44 and 38 can be energized while compressor 50 is turned off. For even higher capacity, all three compressors 38, 44 and 50 can be activated. Although the capacity of compressor system 12 is varied by selectively energizing individual compressors, it should be appreciated by those of ordinary skill in the art that there are many other well-known ways of varying the capacity of a multi-compressor system or a single compressor, and such ways are well within the scope of the invention.

At any operating capacity, evaporator coil 48 and variable refrigerant metering device 16 preferably are active operating elements of system 10. At minimum capacity, only circuit 36 is active, whereby refrigerant in condenser coil 46 releases heat to a fluid 55 (e.g., to outside air or to water from a cooling tower), and refrigerant in evaporator coil 48 absorbs heat from a fluid 56 being cooled. Fluid 56 can be supply air blown across evaporator 14 and then conveyed to a comfort zone such as a room or area in a building, or fluid 14 can be so-called "chilled water" that is forced across evaporator 14 and then pumped to one or more remote heat exchangers, which in turn cool a comfort zone.

While operating at minimum capacity, system 10 meets the cooling demand under various operating conditions by controlling the opening of variable metering device 16 in response to an appropriate sensor 58 that senses a thermodynamic property (e.g., temperature, pressure, etc.) of the refrigerant flowing from evaporator coil 48 to suction side 22 of compressor system 12. Sensor 58, for example, can be a hermetically sealed bulb filled with a fluid having pressure that varies with the temperature of one line 28 leading to compressor 44, and the changing pressure in bulb 58 acts upon variable metering device 16 to adjustably throttle the refrigerant. In this example, variable metering device 16 would be a common thermal expansion valve. Alternatively, variable metering device 16 could be a conventional electronic expansion valve.

For higher capacity, compressors 38 and 44 are energized to activate circuits 34 and 36. At this higher capacity, refrigerant in condenser coils 40 and 46 release heat to fluid 55, and refrigerant in evaporator coils 42 and 48 absorb heat from fluid 56. Although fixed refrigerant metering device 20 presents a generally constant flow restriction to the refrigerant flowing to evaporator coil 42, system 10 can still meet the cooling demand under various conditions by modulating variable metering device 16.

In cases where fluid 56 is air, moisture from the air might condense on the relatively cool evaporator 14. To prevent such condensate from dripping off a relatively cold evaporator coil and onto a warmer or inactive lower one, variable metering device 16 preferably is adjusted to maintain the refrigerant leaving coil 48 at a lower superheat than that of the refrigerant exiting coil 42. If this were not done, condensate dripping onto a relatively warm or inactive evaporator coil could be entrained by air 56 flowing across evaporator 14. The entrained moisture could then be released to the comfort zone, thereby adversely increasing the room's humidity. With coil 48 being the lowest coil in evaporator 14, and with the refrigerant leaving coil 48 being controlled to have the lowest superheat of the three coils 42, 48 and 54, this helps ensure that water condensate 60 dripping off evaporator 14 properly drains into a suitable condensate drain pan 62.

At full or maximum capacity, all three compressors 38, 44 and 50 are energized to activate circuits 32, 34 and 36. At full capacity, refrigerant in condenser coils 40, 46 and 52 release heat to fluid 55, and refrigerant in evaporator coils 42, 48 and 54 absorb heat from fluid 56. Fixed refrigerant metering devices 18 and 20 (e.g., orifice, capillary, etc.) each are sized preferably to provide a flow restriction that is sufficient to ensure that most of the refrigerant passing through their respective coils 54 and 42 vaporizes therein to reduce or avoid flooding of those coils; otherwise, a flooded coil might release liquid refrigerant to suction side 22 of compressor system 12, which might damage one or more of the compressors. Moreover, a refrigerant system with flooded evaporators generally requires a greater overall charge of refrigerant. Although fixed refrigerant metering devices 18 and 20 present generally constant flow restrictions to the refrigerant flowing to evaporator coils 54 and 42, system 10 can still meet the cooling demand under various conditions by modulating variable metering device 16. To prevent water condensate from dripping off a relatively cold evaporator coil and onto a warmer or inactive lower one, variable metering device 16 preferably is adjusted to maintain the refrigerant leaving coil 48 at a lower superheat than that of the refrigerant exiting coils 42 and 54.

With coil 48 being the lowest of the three evaporator coils 42, 48 and 54, and with coil 48 and variable refrigerant metering device 16 always being active when system 10 is operating in a cooling mode at any capacity, variable refrigerant metering device 16 can controllably ensure that the refrigerant in the lowest coil, i.e., coil 48, releases refrigerant at a relatively low superheat to help prevent water condensate 60 from being blown into the comfort zone.

As an alternative to positioning coil 48 physically lower than coils 42 and 54, a refrigerant system 10' of FIG. 2 includes an evaporator 14' with coils 42', 48' and 54' being intertwined. This arrangement of coils provides evaporator 14' with a more even temperature distribution to avoid the problem of air 56 entraining water condensate from the coils. Otherwise, the structure and function of systems 10 and 10' are basically the same. Although coils 42', 48' and 54' are in intimate heat-transfer contact with each other, they are still independent coils that are hermetically isolated.

In another example refrigerant system 10", shown in FIG. 3, compressors 38 and 44, condenser coils 40 and 46, metering devices 16 and 20, and evaporator coils 42 and 48 are connected in fluid communication due to a suction manifold 64. The structure and function of systems 10 and 10", otherwise, are basically the same.

As a variation to system 10" of FIG. 3 or system 10 of FIG. 1, compressor 50, condenser coil 52, fixed refrigerant metering device 18, and evaporator coil 54 could be omitted from those systems.

Although the invention is described with respect to a preferred embodiment, modifications thereto will be apparent to those of ordinary skill in the art. The scope of the invention, therefore, is to be determined by reference to the following claims:

The invention claimed is:

1. A refrigerant system that circulates a refrigerant, the refrigerant system comprising:

a compressor system of variable capacity, the compressor system has a suction side and a discharge side;

a first condenser coil connected to receive the refrigerant from the discharge side of the compressor system;

a second condenser coil connected to receive the refrigerant from the discharge side of the compressor system;

a fixed refrigerant metering device connected to receive the refrigerant from the first condenser coil;

a variable refrigerant metering device connected to receive the refrigerant from the second condenser coil;

a first evaporator coil connected to receive the refrigerant from the fixed refrigerant metering device and being further connected to release the refrigerant to the suction side of the compressor system; and a second evaporator coil connected to receive the refrigerant from the variable refrigerant metering device and being further connected to release the refrigerant to the suction side of the compressor system, the refrigerant in the second evaporator coil is at a lower superheat than the refrigerant in the first evaporator coil.

2. The refrigerant system of claim 1, wherein the first condenser coil, the fixed refrigerant metering device, and the first evaporator coil are hermetically isolated from the second condenser coil, the variable refrigerant metering device, and the second evaporator coil.

3. The refrigerant system of claim 1, wherein the compressor system comprises two compressors that are selectively energized individually and in combination to provide the compressor system with variable capacity.

4. The refrigerant system of claim 1, wherein the fixed refrigerant metering device is one of two fixed refrigerant metering devices that are hermetically isolated from each other, and the compressor system comprises a first compressor, a second compressor and a third compressor that are selectively energized individually and in combination to provide the compressor system with variable capacity, the first compressor and the second compressor share a common refrigerant circuit that is hermetically isolated from the third compressor, the common refrigerant circuit includes the variable refrigerant metering device and one of the two fixed refrigerant metering devices, and the third compressor is connected in fluid communication with one of the two fixed refrigerant metering devices.

5. The refrigerant system of claim 1, wherein the first evaporator coil and the second evaporator coil are intertwined with each other.

6. The refrigerant system of claim 1, wherein the second evaporator coil extends physically lower than the first evaporator coil.

7. The refrigerant system of claim 1, wherein most of the refrigerant passing through the first evaporator coil vaporizes inside the first evaporator coil, thereby reducing flooding of the first evaporator coil.

8. A refrigerant system that circulates a refrigerant, the refrigerant system comprising:

a compressor system of variable capacity, the compressor system has a suction side and a discharge side;

a first condenser coil connected to receive the refrigerant from the discharge side of the compressor system;

a second condenser coil connected to receive the refrigerant from the discharge side of the compressor system;

a fixed refrigerant metering device connected to receive the refrigerant from the first condenser coil;

a variable refrigerant metering device connected to receive the refrigerant from the second condenser coil; and a complete evaporator system comprising an uppermost evaporator coil and a lowermost evaporator coil, the uppermost evaporator coil is connected to receive the refrigerant from the fixed refrigerant metering device and is further connected to release the refrigerant to the suction side of the compressor system, the lowermost evaporator coil is connected to receive the refrigerant from the variable refrigerant metering device and is further connected to release the refrigerant to the suction side of the compressor system, the lowermost evaporator coil extends lower than the uppermost evaporator coil.

9. The refrigerant system of claim 8, wherein the first condenser coil, the fixed refrigerant metering device, and the uppermost evaporator coil are hermetically isolated from the second condenser coil, the variable refrigerant metering device, and the lowermost evaporator coil.

10. The refrigerant system of claim 8, wherein the compressor system comprises two compressors that are selectively energized individually and in combination to provide the compressor system with variable capacity.

11. The refrigerant system of claim 8, wherein the fixed refrigerant metering device is one of two fixed refrigerant metering devices that are hermetically isolated from each other, and the compressor system comprises a first compressor, a second compressor and a third compressor that are selectively energized individually and in combination to provide the compressor system with variable capacity, the first compressor and the second compressor share a common refrigerant circuit that is hermetically isolated from the third compressor, the common refrigerant circuit includes the variable refrigerant metering device and one of the two fixed refrigerant metering devices, and the third compressor is connected in fluid communication with one of the two fixed refrigerant metering devices.

12. The refrigerant system of claim 8, wherein most of the refrigerant passing through the uppermost evaporator coil vaporizes inside the uppermost evaporator coil, thereby reducing flooding of the uppermost evaporator coil.

13. The evaporator system of claim 8, wherein the refrigerant in the lowermost evaporator coil, which receives refrigerant from the variable refrigerant metering device, is at a lower superheat than the refrigerant in the uppermost evaporator coil.

14. A method of controlling a refrigerant system that circulates a refrigerant through a compressor system of variable capacity, a first condenser coil connected to receive the refrigerant from a discharge side of the compressor system, a second condenser coil connected to receive the refrigerant from the discharge side of the compressor system, a first evaporator coil connected to release the refrigerant to a suction side of the compressor system, and a second evaporator coil connected to release the refrigerant to the suction side of the compressor system, the method comprising:

conveying refrigerant from the first condenser coil to the first evaporator coil via a fixed refrigerant metering device;

conveying refrigerant from the second condenser coil to the second evaporator coil via a variable refrigerant metering device;

selectively operating the compressor system at a higher capacity and a lower capacity; and when operating the compressor system at the lower capacity, heating the refrigerant in the first evaporator coil to a higher superheat than that of the refrigerant in the second evaporator coil.

15. The method of claim 14, further comprising positioning the second evaporator coil below the first evaporator coil.

16. The method of claim 14, further comprising hermetically isolating the first evaporator coil and the second evaporator coil from each other.

17. The method of claim 14, further comprising vaporizing within the first evaporator coil most of the refrigerant that passes through the first evaporator coil.

* * * * *